US009139328B2

(12) United States Patent
Miura et al.

(10) Patent No.: US 9,139,328 B2
(45) Date of Patent: Sep. 22, 2015

(54) SYNTHETIC RESIN CONTAINER

(75) Inventors: Masaki Miura, Yokohama (JP); Kazushi Matsukiyo, Yokohama (JP)

(73) Assignee: TOYO SEIKAN KAISHA, LTD., Tokyo (JP)

( * ) Notice: Subject to any disclaimer, the term of this patent is extended or adjusted under 35 U.S.C. 154(b) by 516 days.

(21) Appl. No.: 12/736,243

(22) PCT Filed: Mar. 19, 2009

(86) PCT No.: PCT/JP2009/055387

§ 371 (c)(1), (2), (4) Date: Sep. 23, 2010

(87) PCT Pub. No.: WO2009/119424

PCT Pub. Date: Oct. 1, 2009

(65) Prior Publication Data

US 2011/0011873 A1 Jan. 20, 2011

(30) Foreign Application Priority Data

Mar. 25, 2008 (JP) ..... 2008-078897
Mar. 28, 2008 (JP) ..... 2008-088398
Apr. 7, 2008 (JP) ..... 2008-099106

(51) Int. Cl.
*B65D 1/44* (2006.01)
*B65D 1/02* (2006.01)
*B65D 79/00* (2006.01)

(52) U.S. Cl.
CPC ..... *B65D 1/44* (2013.01); *B65D 1/0284* (2013.01); *B65D 79/005* (2013.01)

(58) Field of Classification Search
USPC ..... 215/382, 371–375
See application file for complete search history.

(56) References Cited

U.S. PATENT DOCUMENTS 3,598,270 A * 8/1971 Adomaitis et al. ..... 215/375
3,727,783 A * 4/1973 Carmichael ..... 215/375
3,935,955 A * 2/1976 Das ..... 215/375
4,267,144 A * 5/1981 Collette et al. ..... 264/523
4,301,933 A * 11/1981 Yoshino ..... 215/375
4,355,728 A * 10/1982 Ota et al. ..... 215/375
4,850,494 A * 7/1989 Howard, Jr. ..... 215/375

(Continued)

FOREIGN PATENT DOCUMENTS

JP H03-97014 U 10/1991
JP H06-44807 U 11/1994

(Continued)

*Primary Examiner* — Tri Mai
(74) *Attorney, Agent, or Firm* — Manabu Kanesaka

(57) ABSTRACT

A synthetic resin container, in which the bottom part 4 having a bottom plate part 41 which is present at the center of the bottom part and a peripheral part 42 which is positioned at the periphery of the bottom plate part 41, in the peripheral part 42, a grounding part 422 having an inside slope 422*a* which rises outwardly of the container with the outer peripheral edge of the bottom plate part 41 being the start point and an outside slope 422*b* which continues to the side surface of the bottom part 4 is formed, and when a load is applied in the axial direction in the state where the container stands upright on the grounding surface G, the shape of the bottom part 4 changes reversibly such that the bottom plate part 41 is depressed inwardly to the container. As a result, it is possible to avoid deformation of a container into an unintended shape by buckling or the like even if a load is applied to a container in the axial direction, and to ensure the rigidity of a container against a load in the axial direction.

2 Claims, 7 Drawing Sheets

(56) References Cited

U.S. PATENT DOCUMENTS

| | | | | |
|---|---|---|---|---|
| 5,261,543 | A * | 11/1993 | Ugarelli | 215/375 |
| 5,287,978 | A * | 2/1994 | Young et al. | 215/375 |
| 5,427,258 | A * | 6/1995 | Krishnakumar et al. | 215/400 |
| 5,713,480 | A * | 2/1998 | Petre et al. | 215/373 |
| 5,851,478 | A * | 12/1998 | Iizuka et al. | 264/520 |
| 6,612,451 | B2 * | 9/2003 | Tobias et al. | 215/375 |
| 6,857,531 | B2 * | 2/2005 | Slat et al. | 215/382 |
| 7,461,756 | B2 * | 12/2008 | Pedmo et al. | 215/375 |
| 7,543,713 | B2 * | 6/2009 | Trude et al. | 215/373 |
| 2003/0006208 | A1 | 1/2003 | Cheng et al. | |
| 2004/0211746 | A1 * | 10/2004 | Trude | 215/374 |
| 2007/0045220 | A1 * | 3/2007 | Pedmo et al. | 215/375 |

FOREIGN PATENT DOCUMENTS

| | | |
|---|---|---|
| JP | H11-152123 | 6/1999 |
| JP | 2001-031010 | 2/2001 |
| JP | 2006-103735 | 4/2006 |

* cited by examiner

SYNTHETIC RESIN CONTAINER

RELATED APPLICATIONS

The present application is National Phase of International Application No. PCT/JP2009/055387 filed Mar. 19, 2009, and claims priorities from Japanese Applications No. 2008-078897 filed Mar. 25, 2008; No. 2008-088398 filed Mar. 28, 2008 and No. 200-099106 filed Apr. 7, 2008, the disclosure of which is hereby incorporated by reference herein in its entirety.

TECHNICAL FIELD

The present invention relates to a synthetic resin container molded in a shape of a bottle.

BACKGROUND ART

Conventionally, a synthetic resin container obtained by forming a preform using a synthetic resin such as polyethylene terephthalate, and molding this preform into the shape of a bottle by stretch blow molding or the like is known as a container for drinks which contains various drinks as its contents (see Patent Document, or the like).

Further, for filling this type of a synthetic resin container with contents, a method is known, as the filling sealing method, in which the inside of the container is allowed to have a positive pressure by adding a slight amount of liquid nitrogen (see Patent Document 2, or the like).

Patent Document 1: JP-A-2006-103735

Patent Document 2: JP-A-2001-31010

DISCLOSURE OF THE INVENTION

Problems to be Solved by the Invention

Meanwhile, in recent years, a decrease in weight or a reduction in cost by decreasing the amount of a resin used has been strongly required for this type of synthetic resin container. Under such circumstances, various attempts have been made to mold the container as thin as possible. In Patent Document 1, an attempt is made to allow the wall thickness of a container to be thin. However, only by allowing a container to have a thin wall thickness, the rigidity of a container is deteriorated due to such a reduction in wall thickness.

Therefore, for example, after shipping containers which have been filled with contents and sealed, containers may often be stacked one upon another during the transportation or storage. Therefore, there is a problem that when a load is applied in the axial direction at this time, the containers may not withstand this load, and may be deformed by buckling, whereby the commercial value thereof is significantly deteriorated.

On the other hand, according to the invention of Patent Document 2, advantageous effects such as a significant increase in buckling resistance strength after the filling of contents, which leads to an increase in the number of stacks, can be expected by allowing the inside of the container to be positively pressurized by adding liquid nitrogen.

However, in order to positively pressurize the inside of a container by adding liquid nitrogen, the inside pressure of each container may be varied unless the amount of liquid nitrogen to be added is strictly adjusted. In addition, the height of the liquid level in a head space may also be varied easily. In addition, since a significant increase in pressure is expected by the vaporization of liquid nitrogen, even in the case where non-carbonic drink is filled as contents, the container shape is restricted to a shape that can withstand such pressure.

The invention has been made in view of the above-mentioned circumstances, and an object thereof is to provide a synthetic resin container of which the rigidity can be ensured such that deformation of a container in a shape which is not intended by buckling deformation or the like can be prevented when a load is applied in the axial direction

Means for Solving the Problems

The synthetic resin container according to the present invention has a configuration in which it comprises a mouth part, a trunk part and a bottom part, the bottom part having a bottom plate part which is present at the center of the bottom part and a peripheral part which is positioned at the periphery of the bottom plate part, in the peripheral part, a grounding part having an inside slope which rises outwardly of the container with the outer peripheral edge of the bottom plate part being the start point and an outside slope which continues to the side surface of the bottom part are formed, and when a load is applied in the axial direction in the state where the container stands upright on the grounding surface, the shape of the bottom part changes reversibly such that the bottom plate part is depressed inwardly to the container.

Advantageous Effects of the Invention

According to the synthetic resin container with the above-mentioned configuration, when a load is applied in the axial direction after a container is sealed or a container is filled with contents and sealed, the shape of the bottom part changes reversibly so that the bottom plate part thereof is depressed to the container inwardly to raise the pressure in a container, whereby a decrease in pressure in the container is suppressed or the pressure of the container becomes positive. As a result, the rigidity of a container against the external force is ensured and hence it is possible to effectively avoid deformation of a container into an unintended shape by buckling or the like even if a load is applied to a container in the axial direction.

EXPLANATION OF SYMBOLS

Figure 1:
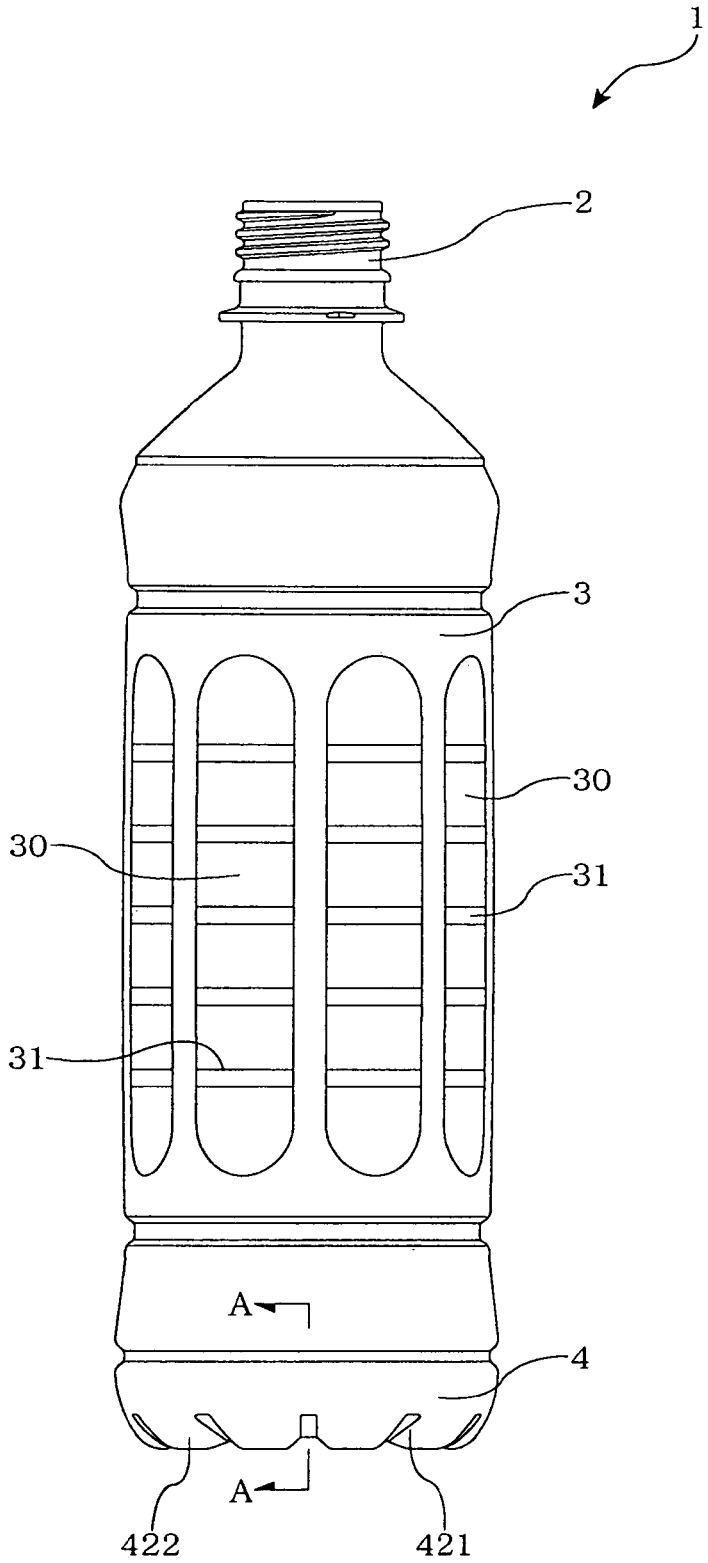
FIG. 1 is an elevational view showing the example of the synthetic resin container according to the present invention.

1 Container
2 Mouth part
3 Trunk part

4 Bottom part
41 Bottom plate part
411 Step part
42 Peripheral part
421 Groove part
422 Grounding part
422*a* Inside slope
422*b* Outside slope
X Axial core

BEST MODE FOR CARRYING OUT THE INVENTION

A preferred embodiment of the present invention will be explained hereinbelow with reference to the drawings.

Figure 2:
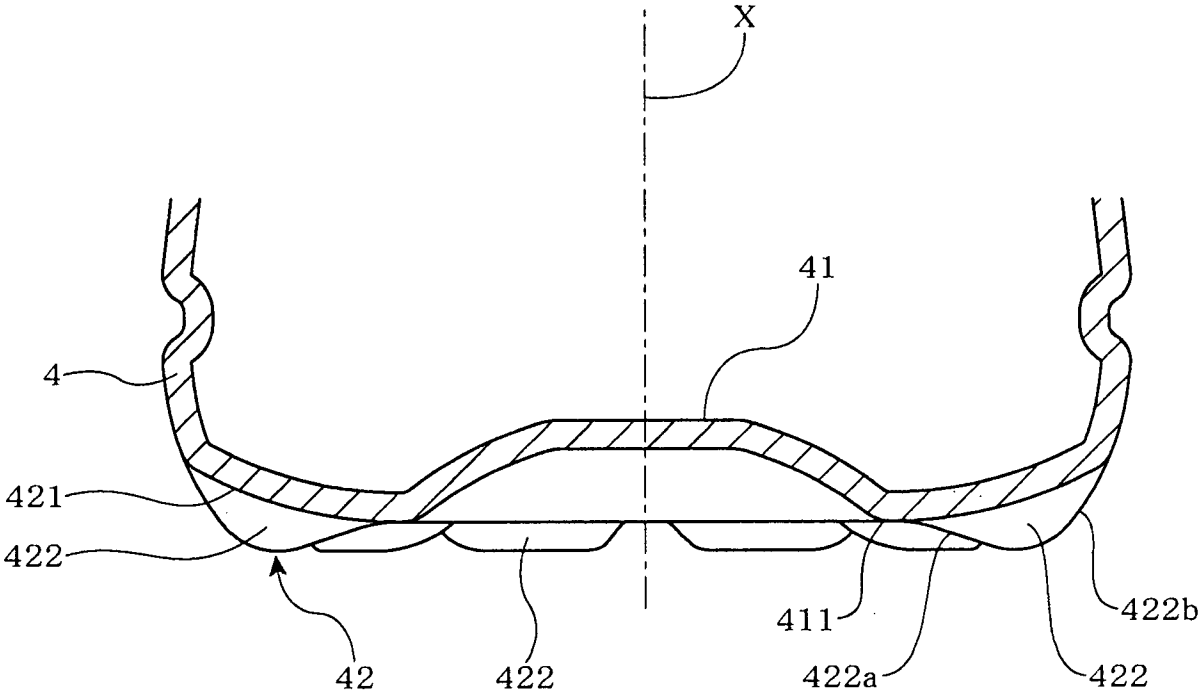
FIG. 2 is a cross-sectional view taken along line A-A in FIG. 1.
Figure 3:
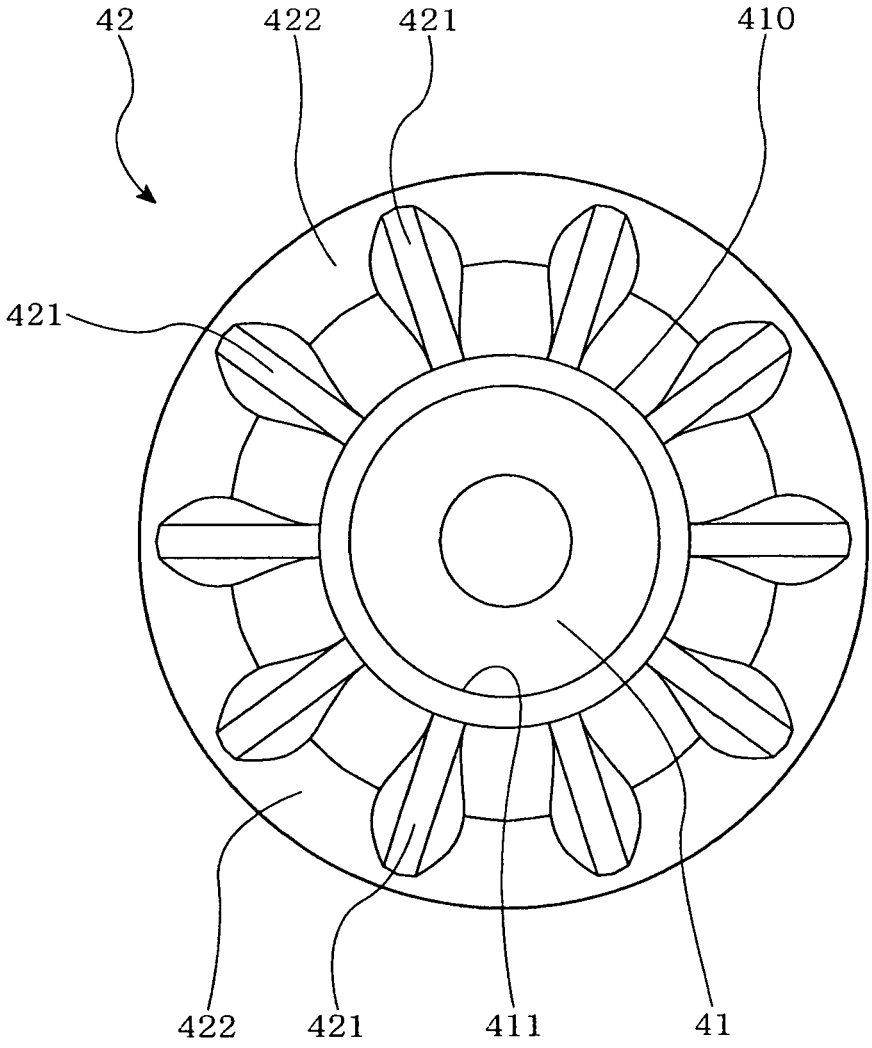
FIG. 3 is a bottom plan view showing the example of the synthetic resin container according to the present invention.

FIG. 1 is an elevational view showing one example of the synthetic resin container according to this embodiment. FIG. 2 is a cross-sectional view taken along line A-A shown in FIG. 1, and FIG. 3 is a bottom view of the container 1 shown in FIG. 1.

In this embodiment, for example, the container 1 can be molded into a predetermined shape provided with a mouth part 2, a trunk part 3 and a bottom part 4, as shown, by subjecting a bottomed cylindrical preform formed of a thermoplastic resin which is produced by known injection molding, compression molding or the like to biaxial stretch blow molding, etc.

As a thermoplastic resin used for molding the container 1, arbitrary resins can be used if stretch blow molding is possible. As the specific examples thereof, thermoplastic polyesters, such as polyethylene terephthalate, polybutylene terephthalate, polyethylene naphthalate, polycarbonate, polyarylate, polylactic acid or the copolymers thereof, or a blend of these resins or a blend of these resins with other resins can be given. In particular, ethylene terephthalate-based thermoplastic polyesters such as polyethylene terephthalate are preferably used. In addition, acrylonitrile resins, polypropylene, a propylene-ethylene copolymer, polyethylene, etc. can also be used.

In the shown example, the mouth part 2 is formed in a cylindrical shape. On the side surface of the mouth part 2 nearer to the opening end, a thread for attaching a lid body (not shown) is provided as a lid body attaching means. In this way, by attaching the lid body to the mouth part 2 after the container is filled with contents, the container 1 is sealed.

Moreover, a plurality of internal pressure adjustment panels 30 is formed on the side surface of a trunk part 4. The internal pressure adjustment panel 30 mainly serves to offset a decrease in internal pressure by its deformation when the pressure inside the container is decreased by cooling after the container is filled with contents and sealed at high temperatures or when air in the head space of the container which is filled with contents is dissolved in the contents, thereby to decrease the pressure inside. In the shown example, eight vertical internal pressure adjustment panels 30 are formed in the axial direction. As such internal pressure adjustment panel 30, panels in various forms which have conventionally been known can be used. However, in this embodiment, it is preferred that a plurality of lateral grooves 31 be arranged at almost equal intervals in the axial direction in the internal pressure adjustment panel 30. A detailed explanation will be made later on this matter.

Figure 5:
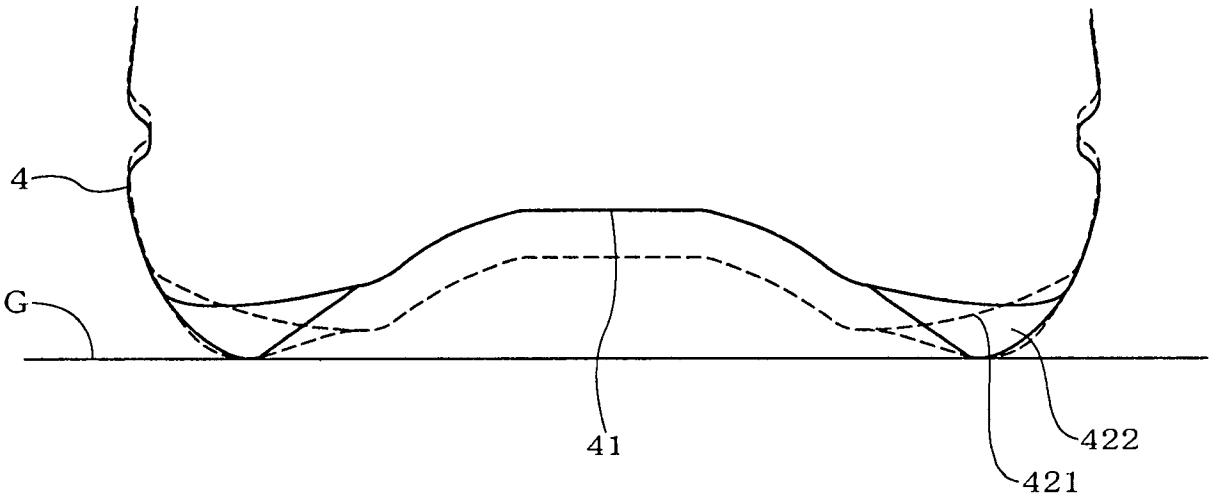
FIG. 5 is an explanatory view showing the state before and after the shape of the bottom part changes reversibly.

Furthermore, as shown in FIGS. 2 and 3, the bottom part 4 has a bottom plate part 41 which is present at the center of the bottom part and a peripheral part 42 which is positioned at the periphery of the bottom plate part 41. In the peripheral part 42, a grounding part 422 having an inside slope 422*a* which rises outwardly of the container with the outer peripheral edge of the bottom plate part 41 as a starting point and an outside slope 422*b* which continues to the side surface of the bottom part 41 is formed. As shown in FIG. 5, when a load is applied in the axial direction to the container 1 which stands upright on a grounding surface G, the shape of the bottom part 4 is reversibly changed such that the bottom plate part 41 is depressed inwardly to the container.

In addition, FIG. 5 is an explanatory view showing the state before and after the shape of the bottom 4 changes reversibly, and the bottom part 4 before deformation is shown by a chain line and the bottom part after deformation is shown by a solid line.

In this way, when a load is applied to the container 1, which has been filled with contents and sealed for shipping, in the axial direction thereof by being stacked one upon another during transportation or storage, as mentioned above, the shape of the bottom part 4 changes reversibly to receives a load, and the volume of the container 1 decreases by this deformation. The pressure inside the container 1 increases with a decrease in the volume of the container 1, and a pressure reduction inside the container is suppressed, or the pressure inside the container becomes positive to ensure the rigidity to withstand an external force. As a result, even if a load in the axial direction is applied to the container 1, deformation of the container 1 into an unintended shape by buckling or the like can be effectively avoided.

The amount of contents to be filled can be arbitral as long as the container 1 is sealed. Similar effects can be obtained even if the container 1 is empty. However, it is more effective to reduce the head space within the container by increasing the amount of contents to be filled.

That is, the pressure increase in the container 1 by capacity reduction of the container 1 due to deformation of the bottom part 4 largely depends on the volume decrease of the gas which exists in the head space. Here, assuming that the gas which exists in the head space is an ideal gas, and that the volume decreases only by ΔV and pressure increases only by ΔP from the state that the volume is V and the pressure is P under circumstances where the temperature is fixed, the relationship shown by the following formula (1) is established (Boyle's law).

$$PV=(P+\Delta P)(V-\Delta V) \quad (1)$$

If the formula (1) is solved for ΔP, the following formula (2) will be deduced.

$$\Delta P=P(\Delta V/(V-\Delta V)) \quad (2)$$

From the formula (2), it can be understood that if the amount of volume reduction ΔV is the same, the pressure rises in a greater amount if the original volume V is small. Therefore, even if the absolute amount of a decrease of the volume of the container 1 by the deformation of the bottom part 4 is small, the pressure inside the container increases greatly if the volume of gas present in the head space is small. Therefore, in filling the container with contents, it is preferred that the amount of the contents be increased to decrease the head space.

Moreover, as for the filling temperature of contents, it is desirable to bring it closer to the temperature at the time of distribution as much as possible, thereby to prevent the degree of pressure reduction after filling from lowering. In particular, it is preferred that the contents be filled at normal temperature such that the pressure inside the container during distribution can be kept almost the same as atmospheric pressure. If the pressure inside the container during distribution can be kept almost the same as atmospheric pressure, the pressure inside the container is allowed to be positive easily by a decrease in volume of the container 1 by deformation of the bottom part 4.

Here, as mentioned above, in this embodiment, in the inner pressure adjustment panel 30 formed on the side surface of the trunk part 3, it is preferred that a plurality of lateral grooves 31 be arranged at almost equal intervals in the axial direction. The purpose of this arrangement is, when the pressure inside the container is increased, to prevent the inner pressure adjustment panel 30 from being deformed such that it expands outwardly of the container and to prevent suppression of an increase in pressure inside of the container. As mentioned above, in this embodiment, it is preferred that an increase in pressure inside the container be prevented from being suppressed by the deformation of the container 1 such that it expands outwardly of the container when the pressure inside the container is increased.

Therefore, although the inner pressure adjustment panel 30 is formed on the side surface of the trunk part 3 in the shown example, if the inner pressure adjustment panel 30 is omitted, only a plurality of lateral grooves 31 may be arranged as a reinforcement rib on the side surface of the trunk part 3. In particular, when the trunk part 3 is formed in a polygonal cylindrical shape, to form a reinforcement rib which extends in such a manner that it orthogonally crosses the axial direction irrespective of the presence of the inner pressure adjustment panel 30 is effective to prevent the side surface of the trunk part 3 outwardly of the container, thereby to cause the trunk part 3 to be deformed in a cylindrical shape. As for such a reinforcement rib, it may be one formed in the shape of a column or one formed in the form of a ridgeline, and it may be formed such that it protrudes outwardly of the container or protrudes inwardly of the container. Further, the reinforcement rib may be one which is formed circularly and continuously along the circumferential direction or intermittently along the circumferential direction.

Moreover, when the pressure inside the container increases, even if the bottom plate part 41 is deformed such that it expands outwardly of the container, an increase in pressure inside the container is suppressed to prevent the pressure inside the container from being positive. Therefore, it is preferred that the bottom plate part 41 have a shape which can be prevented from expanding outwardly of the container, for example, have a shape which protrudes inwardly of the container. In order to suppress the bottom plate part 41 from expanding outwardly of the container, in addition to allowing the bottom plate part 41 to protrude inwardly of the container, a radial rib, a circular ridgeline, a circular groove or the like may be provided in the bottom plate part 41.

When the shape of the bottom part 4 is changed as mentioned above, while the height of the container 1 (the length along the axial direction) is changed such that it is decreased according to a load applied in the axial direction, the distance between the bottom plate part 41 and the grounding surface G is changed such that the bottom plate part 41 is away from the grounding surface G. At this time, when the change amount in distance between the bottom plate part 41 and the grounding surface G is larger relative to the change amount in height of the container 1, the bottom part 4 is deformed such that the bottom plate part 41 is depressed more inwardly of the container. As a result, if the change amount in height of the container 1 is relatively small, the inside of the container is allowed to be positively pressurized easily, whereby rigidity to withstand external force is improved. At this time, if the container has a structure in which the change amount in distance between the bottom plate part 41 and the grounding surface G is increased by about several times relative to the change amount in height of the container 1, the inside of the container can be allowed to be positively pressurized easily without causing the appearance of the container 1 to be significantly changed.

In addition, in changing the shape of the bottom part 4 reversibly as mentioned above, it is preferred that, in the peripheral edge part 42, a plurality of groove parts 421, extending towards the side surface of the bottom part 4 with the peripheral edge of the bottom plate part 41 being the start point be formed and that a grounding part 422 be divided into a plurality of parts along the circumferential direction.

If the grounding part 422 is divided into a plurality of parts by such groove part 421, when a load is applied to the container 1 in the axial direction in the state where the container stands upright on the grounding surface G, with the end point or the vicinity of the groove portion 421 located on the side nearer to the side surface of the bottom part 4 being the start point, the entire peripheral part 42 is bent and deformed in such a manner that it supports and rises the outer peripheral edge of the bottom plate part 41. Simultaneously with this, the grounding parts 422 which are adjacent with each other through the groove part 421 are narrowed and bent and deformed such that it further pushes up the groove part 421. These actions are combined, whereby the shape of the bottom part 4 can be changed such that the bottom plate pate 41 can be further depressed inwardly to the inside of the container.

At this time, in order to ensure the above-mentioned change in shape of the bottom part 4, as in the case of the shown example, it is preferred that a plurality of groove parts 421, which are extending radially with the outer peripheral edge of the bottom plate part 41 being the start point, be formed in a radial direction, and that the grounding part 422 be divided at almost equal angular intervals along the circumferential direction by such groove part 421. However, as for the position of the groove part 421, a plurality of groove parts 421 may be arranged helically or adjacent groove parts 421 may be arranged in the shape of a wedge or in the character of "V". As long as the predetermined object is attained, the position of the groove part 421 is not limited to the shown example.

In the shown example, with the outer peripheral edge of the bottom plate part 41 being the starting point, the inside slope 422*a* of the grounding part 422 is allowed to rise, and at the same time, the groove parts 421 are extended with the outer peripheral edge of the bottom plate part 41 being the starting point. In this way, the boundary between the bottom plate part 41 and the peripheral edge part 42 becomes clear, and as a result, when the shape of the bottom part 4 is changed reversibly such that the bottom plate part 41 is depressed inwardly of the container, the entire peripheral edge part 42 is easily bent and deformed such that it supports the outer peripheral edge of the bottom plate part 41 to bring it up.

In the shown example, the bottom of the groove part 421 is formed in a curved surface together with two parallel ridgelines along the direction in which the groove parts 421 are extended. The bottom of the groove part 421 may be formed linearly along a single ridgeline. It is preferred that the bottom of the groove part be formed together with two or more ridgelines formed along the direction in which the groove parts 421 are extended. In this way, the bottom of the groove part 421 is also bent and deformed between the ridgelines, and, hence, the degree by which a bottom plate part 421*a* is depressed inwardly of the container can be larger. At this time, the number of the ridgelines may be gradually increased or decreased along the direction in which the groove part 421 is extended, and the width between the ridgelines may be gradually increased or decreased along the direction in which the groove part 421 is extended.

Further, in order to allow the shape of the bottom part 4 to be reversibly changed with good reproducibility, it is preferred that a plurality of groove parts 421 be radially formed along the radial direction and that the relative relationship of the groove part 421 and the grounding part 422 relative to the grounding surface G.

First, a cross section which includes the axial core X of the container 1 (preferably the axial core of the bottom part 4 when the axial core of the container 1 and the axial core of the bottom part 4 are not in agreement with each other) and divides the grounding part 422 into two parts in circumferential direction is taken as a first virtual surface, and a cross section which includes the axial core of the container 1 (preferably the axial core of the bottom part 4 when the axial core of the container 1 and the axial core of the bottom part 4 are not in agreement with each other) and divides the groove part 421 into two parts in circumferential direction is taken as a second virtual surface. In an overlapped virtual surface obtained by rotating the first virtual surface and the second virtual surface around the axial core X of the container 1 (preferably the axial core of the bottom part 4 when the axial core of the container 1 and the axial core of the bottom part 4 are not in agreement) to allow them to be overlapped one on another, as shown in FIG. 4, the intersection of the inside slope 422*a* of the grounding part 422 and the groove part 421 is taken as A, and the intersection of the outside slope 422*b* of the grounding part 422 and the groove part 421 is taken as B, the intersection of the grounding part 422 and the grounding surface G is taken as C, and the projections relative to the grounding surface of the intersections A and B of the container 1 which are parallel to the axial core X of the container 1 (preferably the axial core of the bottom part 4 when the axial core of the container 1 and the axial core of the bottom part 4 are not in agreement with each other) are taken as D and E.

In the overlapped virtual surface, when determining the intersection A of the inside slope 422*a* of the grounding part 422 and the groove part 421, the intersection B of the outside slope 422 of the grounding part 422 and the groove part 421 and the intersection C of the grounding part 422 and grounding surface G, they are determined as intersections in the outermost profile of the container 1 on the outer side of the container, without taking into consideration of the wall thickness of the container 1.

Figure 4:
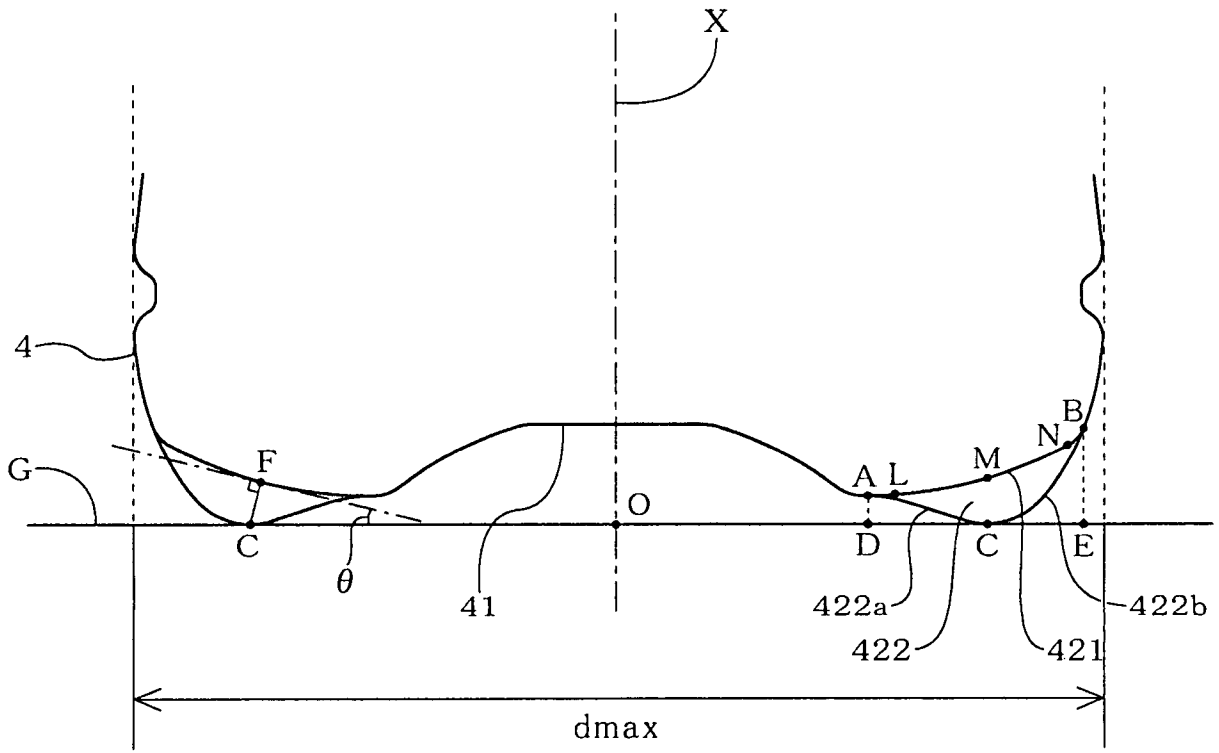
FIG. 4 is an explanatory view showing the relationship between a groove part and a grounding part relative to a grounding surface.
Figure 6:
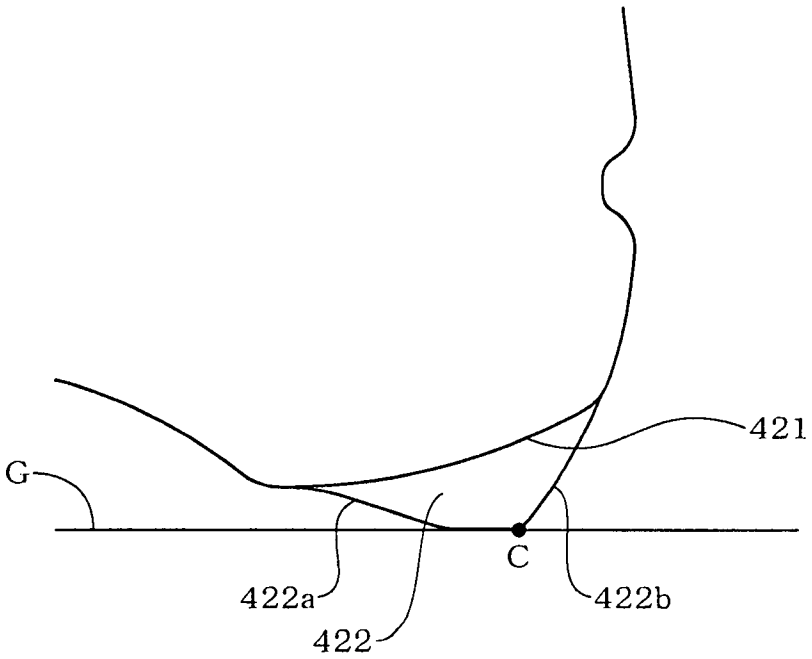
FIG. 6 is an explanatory view showing another example of the synthetic resin container according to the present invention.

Here, FIG. 4 is an explanatory view showing the relative relationship of the groove part 421 and the grounding part 422 relative to the grounding surface G in the overlapped virtual surface. In the shown example, ten grounding parts 422 are provided radially at equal angular intervals. Therefore, a surface which is obtained by rotating the first virtual surface and the second virtual surface around the axial core X of the container 1 (preferably the axial core of the bottom part 4 when the axial core of the container 1 and the axial core of the bottom part 4 are not in agreement) by $[18\pm36\times n]°$ is taken as an overlapped virtual surface (n is an integer). In the example shown in FIG. 4, the grounding part 422 is in point contact with the grounding surface G, and hence, C is determined uniquely. However, if a certain width of the contact part 422 is in contact with the grounding surface G, as shown in FIG. 6, a part which is nearest to the outer side of the container is taken as the intersection C of the grounding part 422 and the grounding surface G in the overlapped virtual surface.

When the points A, B, C, D and E are determined on the overlapped virtual surface as mentioned above, it is preferred that the ratio of the length of the line BE to the length of the line AD (BE/AD) be 0.2 to 12, preferably 0.3 to 0.8 or 2 to 10, and the ratio of the length of the line CE to the length of the line DC (CE/DC) be 0.5 to 1.5.

In this way, the groove part 421 acts more effectively, and the grounding part 422 and the groove part 421 can be bent easily with the end point of the groove part 421 (a position corresponding to the point B as defined above) or the vicinity thereof being the supporting point. In particular, if a straight line AB connecting the point A and the point B as defined above is inclined relative to the grounding surface G, the grounding part and the groove part can be bent more effectively.

Figure 7:
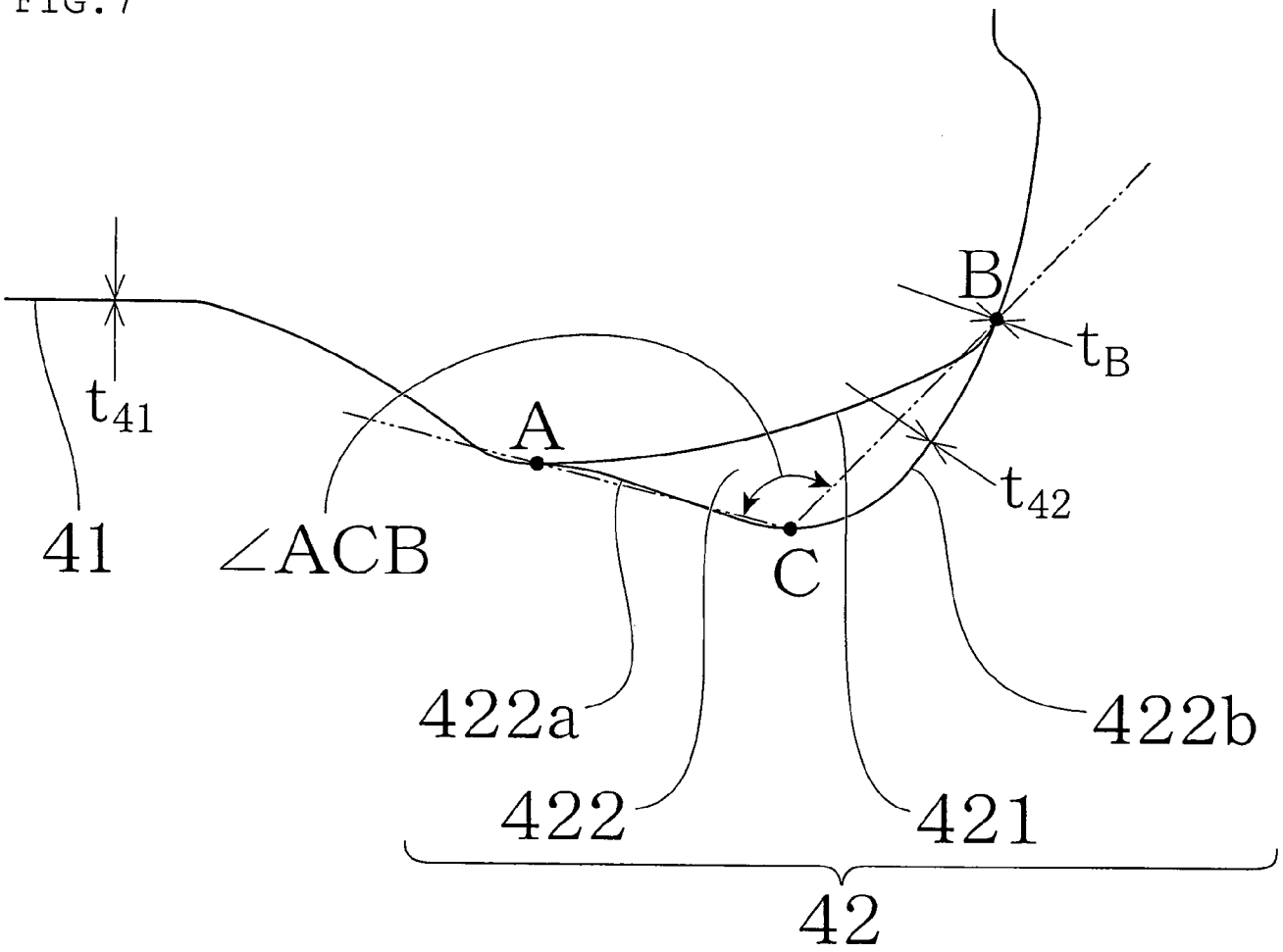
FIG. 7 is an explanatory view showing yet another example of the synthetic resin container according to the present invention.

Further, if the ratio of the length of the line AD to the length of the line DC (AD/DC) exceeds 0 and is less than 1, and the ratio of the length of the line BE to the length of the line CE (BE/CE) exceeds 0 and is less than 1, the angle ACB with the intersection C with the grounding surface G being the vertex becomes obtuse (FIG. 7), and at the same time, the inclination angle of the bottom of the groove part 421 relative to the grounding surface G along the direction in which the groove part 421 is extended becomes relatively small. As a result, the grounding part 422 has a shape (cross-sectional shape on the first virtual surface) which is flat in the axial direction of the container 1. The grounding part 422 can be bent and deformed easily with the point B defined as mentioned above or the vicinity thereof being the supporting point while almost keeping its shape without being buckled by a load applied in the axial direction. In particular, it is preferred that the triangle which consists of the points A, B and C defined as mentioned above becomes a triangle which approximates an isosceles triangle with the angle ACB being an obtuse angle. As a result, the grounding part 422 can fully withstand the load applied in the axial direction, whereby deformation by buckling of the grounding part 422 can be suppressed more effectively.

At this time, as for the angle of inclination of the bottom of the groove part 421 relative to the grounding surface G along the direction in which the groove part 421 is extended, specifically, if the line CF connecting the point C defined as mentioned above and an arbitral point F on the groove part 421 in the overlapped virtual surface as shown in FIG. 4, orthogonally crosses a tangent at the point F relative to the groove part 421 as shown in FIG. 4, it is preferred that the angle θ formed by the tangent and the grounding surface G be 3 to 20° C., more preferably 5 to 18°.

It is preferred that the length of the line CF be set to 2.5 to 3.5 mm since the groove part 421 can effectively act with this length.

Moreover, the angle of inclination of the bottom of the groove relative to the grounding surface G may be constant or may be changed continuously or discontinuously. It is preferred that the bottom of the groove part 421 at least contain a part which has a fixed or variable inclination angle relative to the grounding surface G along the direction in which the groove part 421 extends in a range of 3 to 20°. It is more preferred that it at least contain a part which is fixed or variable in a range of the inclination angle of 5 to 18°. However, it is preferred that the bottom of the groove part 421 be formed in a straight line or a curved line in which no buckling part is present in the direction in which the groove part 421 extends. As a result, the groove part 421 can be prevented from being bent by buckling and deformed, whereby elastic, reversible deformation can be realized easily.

In order to prevent bending of the groove part 321 by bucking, it is preferred that no bent part be present in a wide area excluding the vicinity of the starting point of the groove part 321 (the vicinity of a position corresponding to the point A as defined above) and the vicinity of the end point of the groove part 321 (the vicinity of a position corresponding to the point B as defined above). Specifically, in the overlapped virtual surface shown in FIG. 4, when the middle point of a section AB along the groove part 321 which is defined by points A and B is taken as M, and the point L is taken at a position which is separated from the middle point M to the side nearer to the starting point (the side nearer to the point A) of the groove part 321 along the groove part 421 by 45% of the length of the section AB, and the point N is taken at a position which is separated from the middle point M to the side nearer to the end point (the side nearer to the point B) of the groove part 321 along the groove part 421 by 45% of the length of the section AB, it is preferred that the section LN, which is taken along the groove part 321 which is defined by the points L and N, have a fixed or variable angle of inclination relative to the grounding surface G in a range of 3 to 20°, more preferably 5 to 18°.

Meanwhile, for the convenience of drawing, the points L and N are shown in FIG. 4 at approximate positions.

As a result, the bottom of the groove part 421 has a shape of a straight line or a gently-sloped curve having no bent part in a broad area along the direction in which the groove part 421 is extended. Therefore, deformation by bending by buckling in the middle of the bottom can be prevented further effectively.

As for the section AL formed along the groove part 321 which is defined by the points A and L present in the vicinity of the starting point of the groove part 321 (the vicinity of a portion to be connected to the bottom plate part 41) and and the section BN formed along the groove part 321 which is defined by the points B and N present in the vicinity of the end point of the groove part 321 (the vicinity of a portion to be connected to the side surface of the bottom part 4), as in the case of the section LN, the angle of inclination relative to the grounding surface G may be in a range of 3 to 20° or 5 to 18°. In order to allow the groove part 421 to be connected smoothly to the bottom plate part 41 and the side surfaces of the bottom part 4, the inclination angles of the sections AL and BN relative to the grounding surface G may be outside the above-mentioned range if need arises.

In this embodiment, it is preferred that points C, D and E be defined on the overlapped virtual surface as mentioned above and that, when the intersection of the axial core X of the container 1 (if the axial core of the container 1 is not in agreement with the axial core of the bottom part 4, preferably the axial core of the bottom part 4) with the grounding surface G is taken as O, the ratio of the length of the line OC to the line OE (OC/OE) be 0.5 to 0.9.

In this way, the contact point of the grounding part 422 relative to the grounding surface G is appropriately separated from the end point of the groove part 421 which is positioned on the side nearer to the side surface of the bottom part 4, and as a result, the entire peripheral edge part 42 can be easily bent or deformed with the end point or its vicinity being the supporting point.

It is preferred that the ratio of the length of the line OD to the line OE (OD/OE) be 0.2 to 0.8.

In this way, the start point of the groove part 421 which is present on the outer periphery of the bottom plate part 41 is appropriately separated from the end point of the groove part 421 which is positioned on the side nearer to the side surface of the bottom part 4, and as a result, the entire peripheral edge part 42 can be prevented from being bent or deformed with the end point or its vicinity being the supporting point without the fear that the groove part 421 is stretched.

Further, it is preferred that the ratio of the double of the line OC (2OC/dmax) to the maximum trunk diameter (dmax) of the container be 0.5 to 0.9.

In this way, the position of the contact point of the grounding part 422 relative to the grounding surface G becomes a position which is suitable for the maximum trunk diameter (dmax) of the container, whereby the container 1 is hard to be toppled.

When the shape of the bottom part 4 changes reversibly, the peripheral part 42 which is located around the bottom plate part 41 is deformed. If the wall thickness of this peripheral part 42 is large, the bottom part 4 may be prevented from being deformed. Therefore, in this embodiment, it is preferred that a step part 411 be formed concentrically with the bottom plate part 41 on a position which is nearer to the center than the outer periphery of the bottom plate part 41.

As mentioned above, the container 1 can be formed by subjecting a bottomed cylindrical preform made of a thermoplastic resin to biaxial stretch blowing, etc. At this time, by providing the step part 411 as mentioned above, it is possible to keep the resin to be used for forming the bottom part 4 to the side nearer to the center than the step part 411 in blow molding, whereby the wall thickness distribution of the bottom part 4 can be biased, and the wall thickness ($t_{42}$) of the peripheral part 42 relative to the wall thickness ($t_{41}$) of the bottom plate part 41 is allowed to be relatively thin, whereby the shape change of the bottom part 4 is not prevented.

In addition, by forming the step part 411, a circular reinforcement part is formed between the outer peripheral part of the bottom plate part 41 and step part 411. As a result, force serves to support and lift the outer peripheral edge of the bottom plate part 41 by the bending and deformation of the peripheral part 42 will act more surely through this circular reinforcing part.

The wall thickness of the peripheral edge 42 is preferably set such that the position ($t_B$) or its vicinity, which corresponds to the above-mentioned point B and is present at least on the side nearer to the outside slope 422*b* of the grounding part 422, becomes 0.2 to 0.3 mm. This wall thickness is preferable since the grounding part 422 is easily bent at a position corresponding to the point B or its vicinity, and the thermal resistance or the piercing strength will be increased and insufficient molding (sink marks) is prevented from occurring. Further, the wall thickness of the step part 411 or the bottom plate part 41 is preferably set to 0.35 mm or more, whereby the strength which is sufficient enough to withstand an increase in pressure inside the container can be ensured.

The present invention is explained hereinabove with reference to preferred embodiments. It is needless to say the present invention is restricted to the above-mentioned embodiment, and various modifications can be made within the scope of the present invention.

INDUSTRIAL APPLICABILITY

The synthetic resin container according to the invention as mentioned above can be applied to various synthetic resin containers which are molded into the shape of a bottle.

The invention claimed is:

1. A synthetic resin container for a non-carbonic drink comprising a mouth part, a trunk part and a bottom part, the bottom part having a bottom plate part which is present at a center of the bottom part and a peripheral part which is positioned at a periphery of the bottom plate part, wherein the peripheral part includes a grounding part having an inside slope which rises outwardly of the container from an outer peripheral edge of the bottom plate part and an outside slope which continues to a side surface of the bottom part, and a plurality of groove parts extending radially outwardly from the outer peripheral edge of the bottom plate part and dividing the grounding part into a plurality of parts along a circumferential direction at substantially equal angular intervals, a bottom of each of the groove parts is formed along a curved surface together with two parallel ridgelines along an extending direction of the groove parts, the container includes a first virtual surface including an axis of the container or an axis of the bottom part and dividing the grounding part into two parts in the circumferential direction, and a second virtual surface including the axis of the container or the axis of the bottom part and dividing the groove part into two parts in the circumferential direction, in an overlapped virtual surface wherein the first virtual surface and the second virtual surface are rotated around the axis of the container or the axis of the bottom part to overlap with each other, when the container is placed upright on a grounding surface by defining that an intersection between the inside slope of the grounding part and the groove part is taken as A, an intersection between the outside slope of the grounding part and the groove part is taken as B, and an intersection between the grounding part and the grounding surface is taken as C, a straight line AB connecting the intersection A and the intersection B is inclined to leave from the grounding surface, from the intersection A to the intersection B, and an angle formed by the intersections A, C and B (∠ACB) is obtuse, the bottom plate part has a step part formed concentrically at a position nearer to a center than the outer peripheral edge of the bottom plate part, the peripheral part has a thickness less than that of the bottom plate part, and the position equivalent to the intersection B has a thickness of 0.2 to 0.3 mm, and when a load is applied in an axial direction in a state where the container stands upright on the grounding surface, a shape of the bottom part changes reversibly such that the bottom plate part is depressed inwardly to the container.

2. The synthetic resin container for a non-carbonic drink according to claim 1, wherein the bottom plate part is formed to protrude inwardly of the container.

* * * * *